US008225429B2

(12) United States Patent
Tawfik

(10) Patent No.: US 8,225,429 B2
(45) Date of Patent: Jul. 24, 2012

(54) COLD WEATHER PROTECTION GARMENT

(76) Inventor: Shelley J. Tawfik, Old Brookville, NY (US)

( * ) Notice: Subject to any disclaimer, the term of this patent is extended or adjusted under 35 U.S.C. 154(b) by 169 days.

(21) Appl. No.: 12/861,057

(22) Filed: Aug. 23, 2010

(65) Prior Publication Data

US 2012/0042432 A1 Feb. 23, 2012

(51) Int. Cl.
*A42B 5/00* (2006.01)

(52) U.S. Cl. ..... 2/207; 2/66; 2/91

(58) Field of Classification Search ..... 2/66, 171, 2/202, 203, 206, 207, 208, 88, 89, 90, 91, 2/92, 102; 602/4
See application file for complete search history.

(56) References Cited

U.S. PATENT DOCUMENTS

| | | | | | |
|---|---|---|---|---|---|
| 310,309 | A | * | 1/1885 | Pick | 2/65 |
| 359,872 | A | * | 3/1887 | Levy | 2/92 |
| 384,503 | A | * | 6/1888 | Brahadi | 2/66 |
| 405,097 | A | * | 6/1889 | Kaehler | 2/66 |
| 526,950 | A | * | 10/1894 | Sprung | 2/66 |
| 885,872 | A | * | 4/1908 | Scott | 2/91 |
| 1,066,779 | A | * | 7/1913 | Anderson | 2/66 |
| 1,151,126 | A | * | 8/1915 | Robinson | 2/91 |
| 1,621,323 | A | * | 3/1927 | Horn | 602/4 |
| 1,797,226 | A | * | 3/1931 | Chumbley | 2/91 |
| 2,014,256 | A | * | 9/1935 | Kramer | 2/66 |
| D142,469 | S | * | 10/1945 | Brodigan | D2/500 |
| 2,557,280 | A | * | 6/1951 | Hahn | 2/66 |
| 2,727,241 | A | * | 12/1955 | Smith | 2/66 |
| 2,806,222 | A | * | 9/1957 | Carpenter | 2/91 |
| 2,831,197 | A | * | 4/1958 | Spells | 2/203 |
| 2,870,448 | A | * | 1/1959 | Rosenthal | 2/91 |
| 4,483,469 | A | * | 11/1984 | Arisland | 224/582 |
| 4,495,659 | A | * | 1/1985 | Madnick et al. | 2/66 |
| 4,862,519 | A | * | 9/1989 | Bull | 2/66 |
| 5,139,187 | A | * | 8/1992 | Fowler | 224/576 |
| 5,499,401 | A | * | 3/1996 | Heinmiller | 2/208 |
| 6,406,449 | B1 | * | 6/2002 | Moore et al. | 602/4 |
| D555,330 | S | * | 11/2007 | Cass et al. | D2/866 |
| D583,535 | S | * | 12/2008 | George | D2/864 |
| 7,467,423 | B1 | * | 12/2008 | Tawfik | 2/207 |
| 2005/0039242 | A1 | * | 2/2005 | Edmondson | 2/207 |
| 2006/0248624 | A1 | * | 11/2006 | Pieczynski | 2/16 |

(Continued)

OTHER PUBLICATIONS

Shelly, Knitty Gritty, Nov. 13, 2007, Sista SoFine: Nov. 2007, p. 8, http://www.sistasofine.com/2007_11_01_archive.html.*

(Continued)

*Primary Examiner* — Khoa Huynh
*Assistant Examiner* — Brieanna Fuller
(74) *Attorney, Agent, or Firm* — Ladas & Parry LLP

(57) ABSTRACT

A garment to be worn by a person having a neck and a pair of hands includes a shawl portion with first and second ends and a width extending between first and second edges extending between the ends, and a muff formed at at least one of the first and second ends. The muff has a transversely extending passageway with vertically extending opposed entranceways configured to receive the pair of hands of the person. The muff also has a receptacle pocket with a generally horizontally extending entranceway for carriage of small items located exterior to the passageway. The lower portions of the shawl may be folded upon themselves to form a pair of cuffs, the interior regions of the cuffs leading to the entranceway to the receptacle pocket. The cuffs may be further joined together above the muff to form a bib adjoining the muff.

12 Claims, 7 Drawing Sheets

U.S. PATENT DOCUMENTS

2011/0004971 A1* 1/2011 Benderradji ..... 2/84

OTHER PUBLICATIONS

Sandra Singh, Freshstitches December Pocket Cowl, pp. 1-2, https://id3468.securedata.net/sandrasingh.com/merchantmanager/product__info.php?products__id=3479.*

Little Birdie Design Studio, Oak Tweed Wool Cowl with Pocket, Etsy.com, p. 1, http://www.etsy.com/listing/42954811/oak-tweed-wool-cowl-with-pocket?utm__source=papernstitch&utm__medium=api&utm__campaign=api.*

Littel Birdie Design Studio, Fall 2011 Hand Knit Desgins, Aug. 11, 2011, http://littlebirdiedesignstudio.blogspot.com.*

Vintage Home Arts, Vintage Knitting Pattern-Knitted Warm Shawl Wrap Pockets, eBay, pp. 1-2, http://www.ebay.com/itm/VNTG-Sweater-Warm-Shawl-Wrap-Pockets-Knitting-PATTERN-/390103225020.*

* cited by examiner

COLD WEATHER PROTECTION GARMENT

The present invention relates to an article of clothing and in particular to a cold weather protection garment, preferably in the form of a shawl or scarf with a muff for the hands and a separate receptacle for the carriage of small articles.

BACKGROUND OF THE INVENTION

U.S. Pat. No. 7,467,423 to the present inventor discloses a cold weather protection garment in the form of a scarf with a muff. The muff allows the hands to be received within the muff through vertically oriented openings at opposite sides of the muff. The construction does not, however, provide an effective mechanism for storage of small articles.

It is accordingly a purpose of the present invention to provide a cold weather protection garment which can cover and thus protect the user's shoulders, neck and head, and which provides a muff construction for the wearer's hands as well as a separate secure storage receptacle for small articles.

SUMMARY OF THE INVENTION

In accordance with the foregoing object, the present invention is a garment adapted for wearing about the shoulders and/or head of a person. The garment includes an upper portion that can be draped about the shoulders or worn to cover the head. The upper portion has a pair of ends, at least one but preferably both of which joins a muff having a first horizontally-extending passageway between opposed ends through which at least one hand of the wearer can be inserted and a separate receptacle for the carriage of small articles with vertical sidewalls and an upper, horizontally-extending opening. A wall of the horizontal passageway may also be provided with an interior pocket to allow reception of further small articles. The upper portion of the garment may be of a width such that it can cover a substantial portion of the top of the wearer's head, in the manner of a shawl or hood, but also may be folded back upon itself to facilitate its use in the manner of a scarf, wrapping about the neck and shoulders. At least one of the lower ends of the upper portion may be folded upon itself to define an entryway leading to the muff receptacle's opening, thus assisting the user in accessing the receptacle while serving as a closure for the receptacle.

The construction may be of knit fabric, thus providing an attractive appearance with sufficient bulk to adequately warm the wearer. Alternatively the construction may be of other fabrics, whereby the cold weather protection functionality may be is lessened, the garment serving more as a fashion accessory allowing carriage of small articles in an unobtrusive, hands-free manner.

BRIEF DESCRIPTION OF THE DRAWINGS

A fuller understanding of the present invention will be accomplished upon review of the following detailed description of a preferred but nonetheless illustrative embodiment of the invention, when reviewed in conjunction with the annexed drawings wherein.

DETAILED DESCRIPTION OF THE INVENTION

Figure 1:
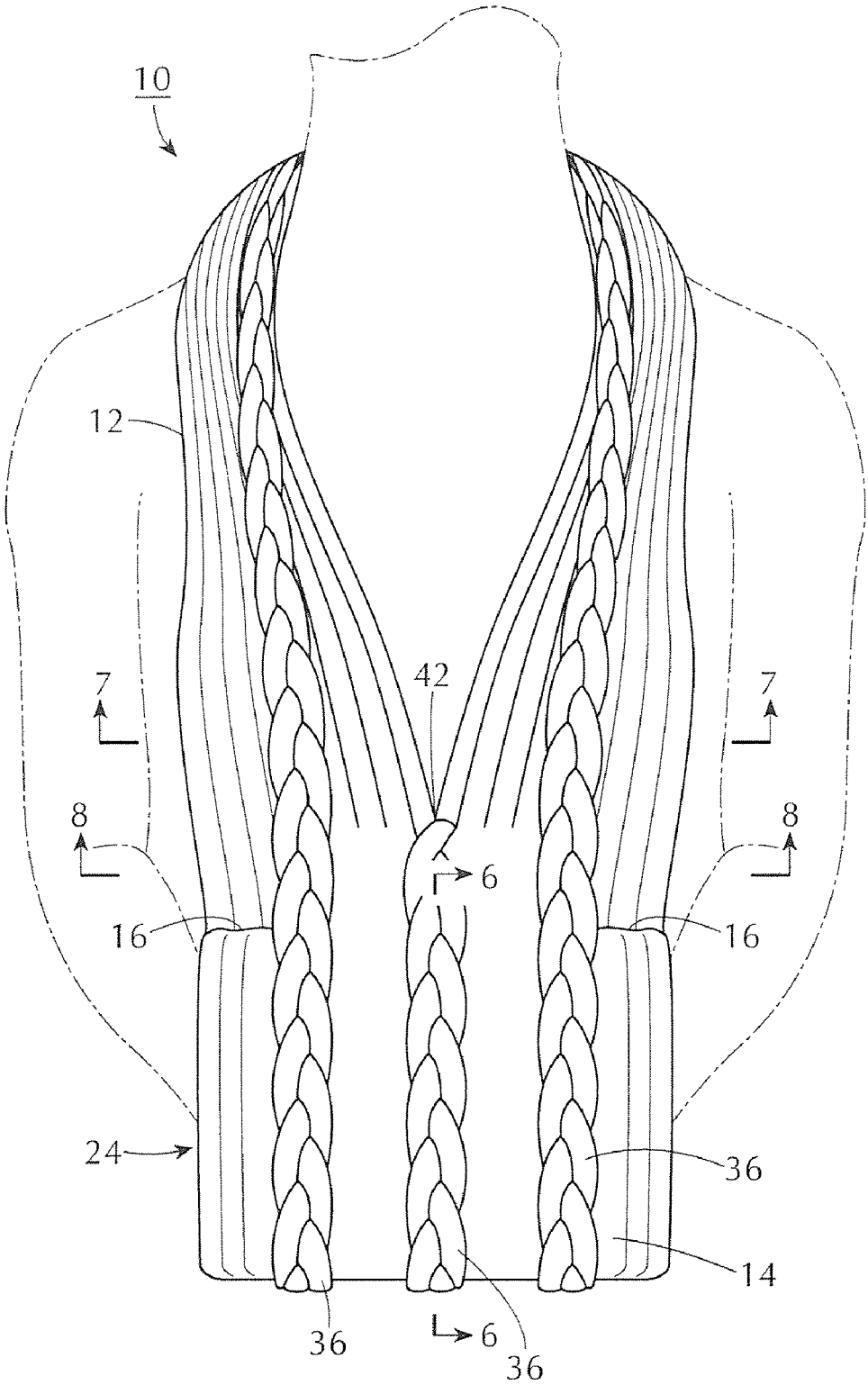
FIG. 1 is an elevation view illustrating an embodiment of the invention as worn by a person with the hands inserted into the horizontal passageway of the muff.
Figure 2:
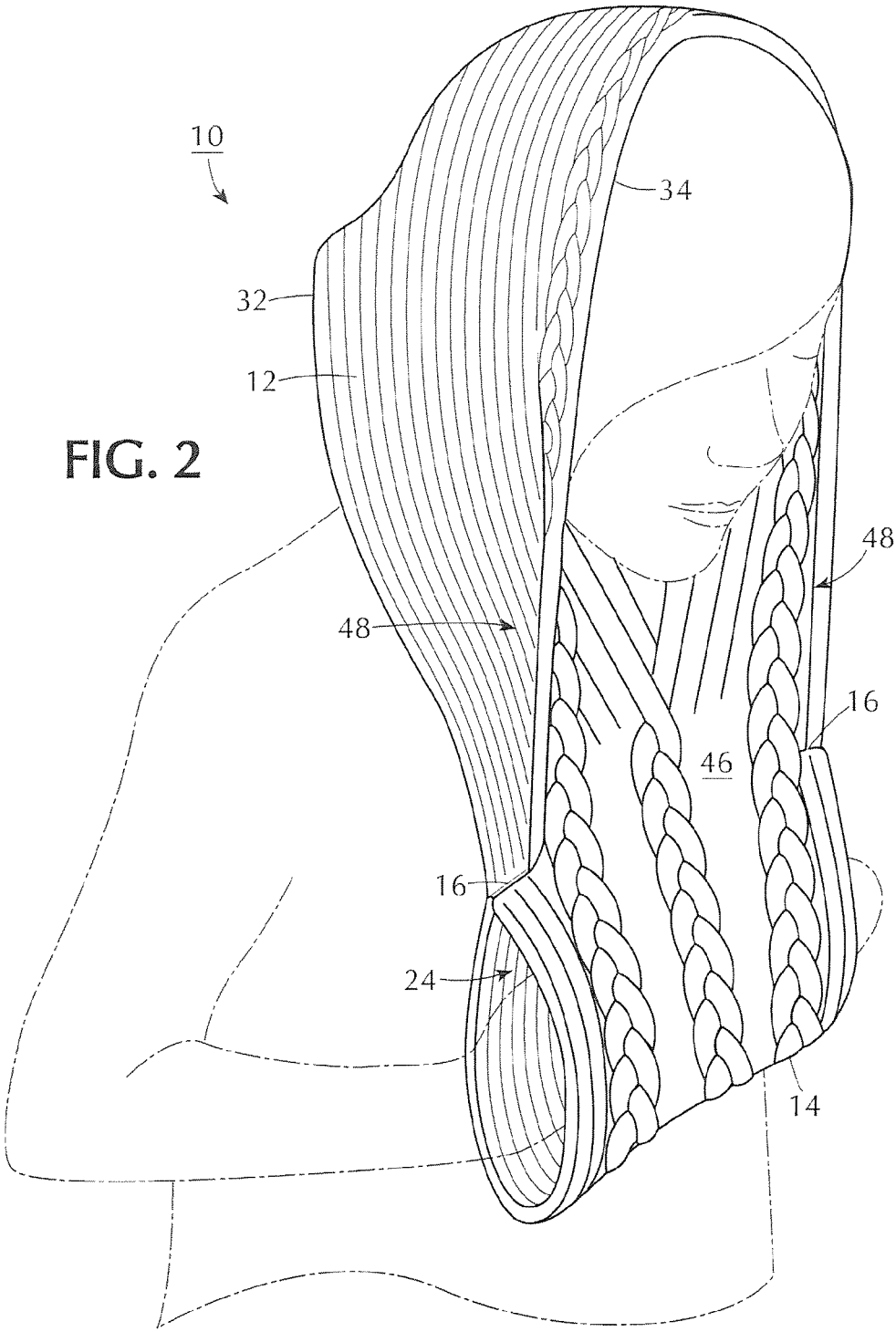
FIG. 2 is a perspective view of the invention of FIG. 1 further illustrating how the upper portion may lie on the wearer's head.

With initial reference to FIGS. 1 and 2, garment 10 includes an upper garment portion 12 and a muff 14 located at the lower end of the portion 12. The upper portion is preferably configured as a scarf or shawl, designed to be wrapped around the wearer's neck and/or head, extend across the shoulders, and drape down over the torso. As used herein, the upper garment portion 12 shall sometimes be referred to as "the shawl portion", it being understood that scarf-like constructions are intended to also be encompassed by the term. The width of the shawl portion 12 between its generally rearwardly-lying side edge 32 and its forwardly-lying side edge 34 as shown in FIG. 2 may be of any desired width, but if intended to be able to cover the head, may be on the order of 10-12 inches or more. When manufactured of a knit fabric having resiliency and stretch, the shawl portion 12 may be capable of extension beyond its initial width. The sides of the shawl portion drape across the shoulders and hang downward, typically to anywhere between mid-chest and waist level. The end-to end length of the shawl portion may be on the order of 30 inches, but may be varied as needed to accommodate wearers of different heights. When worn as a scarf, around the neck and shoulders but not upon the head, as shown for example in FIG. 1, the upper garment portion may be folded back upon itself such that its effective width is less than its edge-to-edge width.

Figure 4:
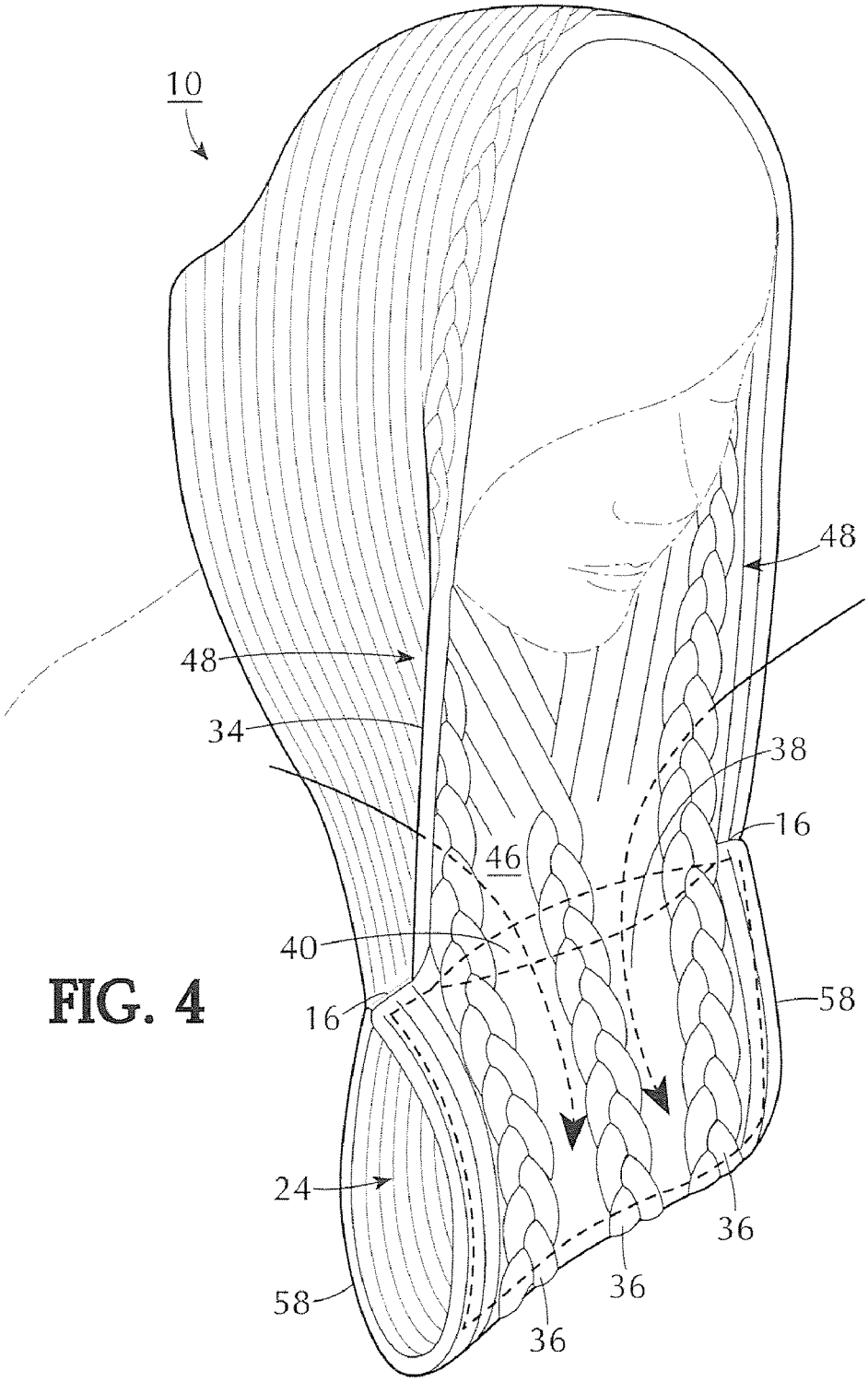
FIG. 4 is a perspective view further detailing how the hands may be inserted into the entranceways of the upper portion and into the receptacle of the muff.
Figure 6:
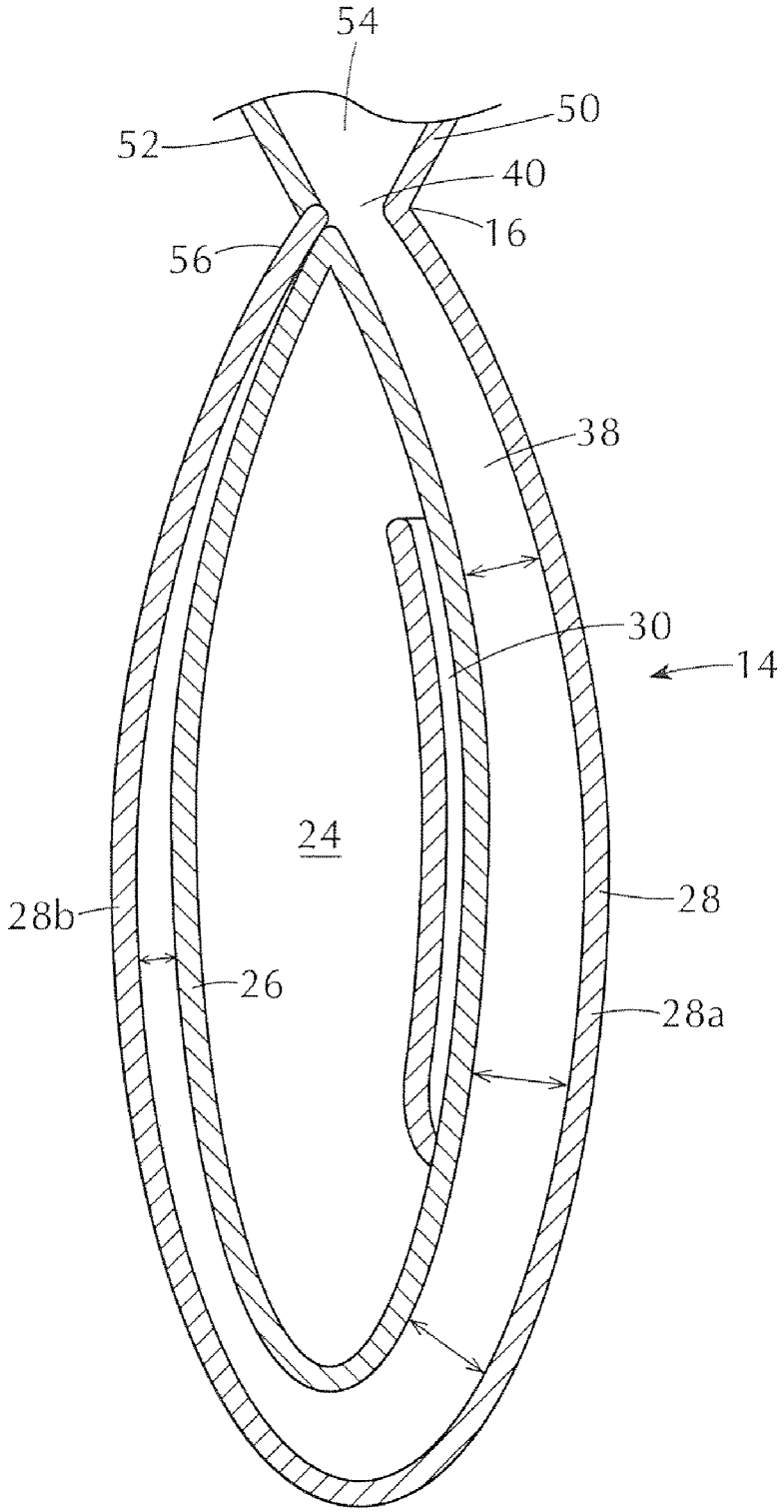
FIG. 6 is a sectional view taken along line 6-6 of FIG. 1 detailing the construction of the muff.

With the shawl portion wrapped around the shoulders, neck, and/or head, at least one of its ends 16 terminates at, and is joined to, the top of muff 14. Muff 14 is of a side-to-side width chosen to accommodate at least one of the user's hands, and is preferably equal to the effective overall width of the lower end or ends of the shawl portion 12 to which it is joined. The muff has a transversely extending horizontal passageway 24 extending across its width, configured and sized to receive the hand(s) of the person wearing the garment, as well as a separate receptacle 38, located exterior to the horizontal passageway 24, for the reception of small articles, such as keys, a change purse, credit cards, and the like (see, e.g., FIG. 4). As may be seen in FIG. 6, muff 14 may preferably be of a double wall construction, formed by inner and outer generally concentric fabric cylinders 26, 28 respectively. Outer fabric cylinder 28 defines the forward cylinder (28*a*) and rear cylinder (28*b*) wall portions of the muff and forms the outer wall of the receptacle 38, configured as a chamber between the cylinders. The inner cylinder 26 forms the horizontal passageway 24, as well as the inner wall of the receptacle 38, the receptacle's entrance opening 40 formed between the inner cylinder 26 and the forward cylinder wall portion 28*a*, affording access to the outwardly-oriented portion of the receptacle chamber. The inner cylinder is joined to rear cylinder wall portion 28*b* at their tops at line 56. The vertical side edges 58 (see FIG. 4) of the two cylinders are joined together along their peripheries (as designated by the double-sided arrows in FIG. 6) to close off the ends of the receptacle. While receptacle 38 can be viewed as the entire volume between the two cylinders, extending both in front of and behind the inner passageway-forming cylinder 26, the receptacle is preferably formed with its entrance opening 40 lying only on one, and preferably the front, side of the inner cylinder, whereby the main effective working volume of the receptacle is thus likewise located on one side of the inner cylinder. The entrance opening 40 for the receptacle 38 extends horizontally, along the top of the muff.

Figure 7:
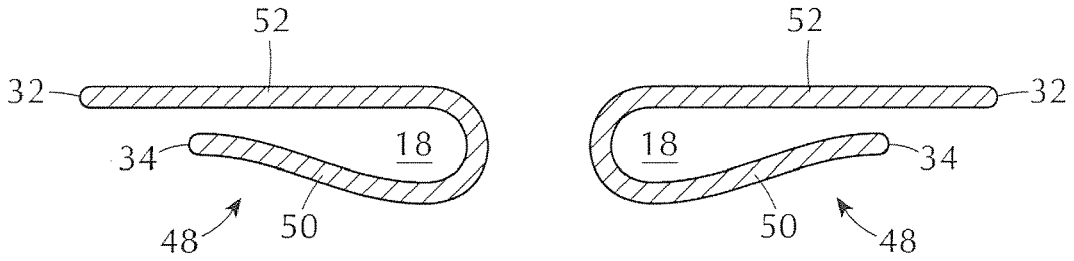
FIG. 7 is a sectional view taken along line 7-7 of FIG, 1 detailing the cuff entranceway to the receptacle.

To facilitate access to the receptacle, one or both of the lower regions of the shawl portion adjacent their ends may be formed into cuffs, serving as an entranceway to the receptacle entrance opening 40. As may be seen in FIGS. 4, 6 and 7, the lower regions of the adjacent and leading to the shawl portion ends 16 are folded upon themselves to form a pair of cuffs 48, the folded width portions 50 adjacent the shawl forward edges 34 overlying the remaining width 52 of the regions. As shown in FIG. 7, the folded cuff construction provides a pair of open-sided chambers 18 between the width portions extending the vertical height of the cuffs.

The cuff ends are joined to the upper edge of the muff 14, the lower ends of width portions 52 being connected to the upper edge of rear cylinder wall portion 28*b*, while the ends of width portions 50 are connected to the upper edge of forward cylinder wall portion 28*a*, the chambers between the cuff widths thus providing an entranceway therebetween to the receptacle entrance opening 40. See FIG. 6.

Figure 3:
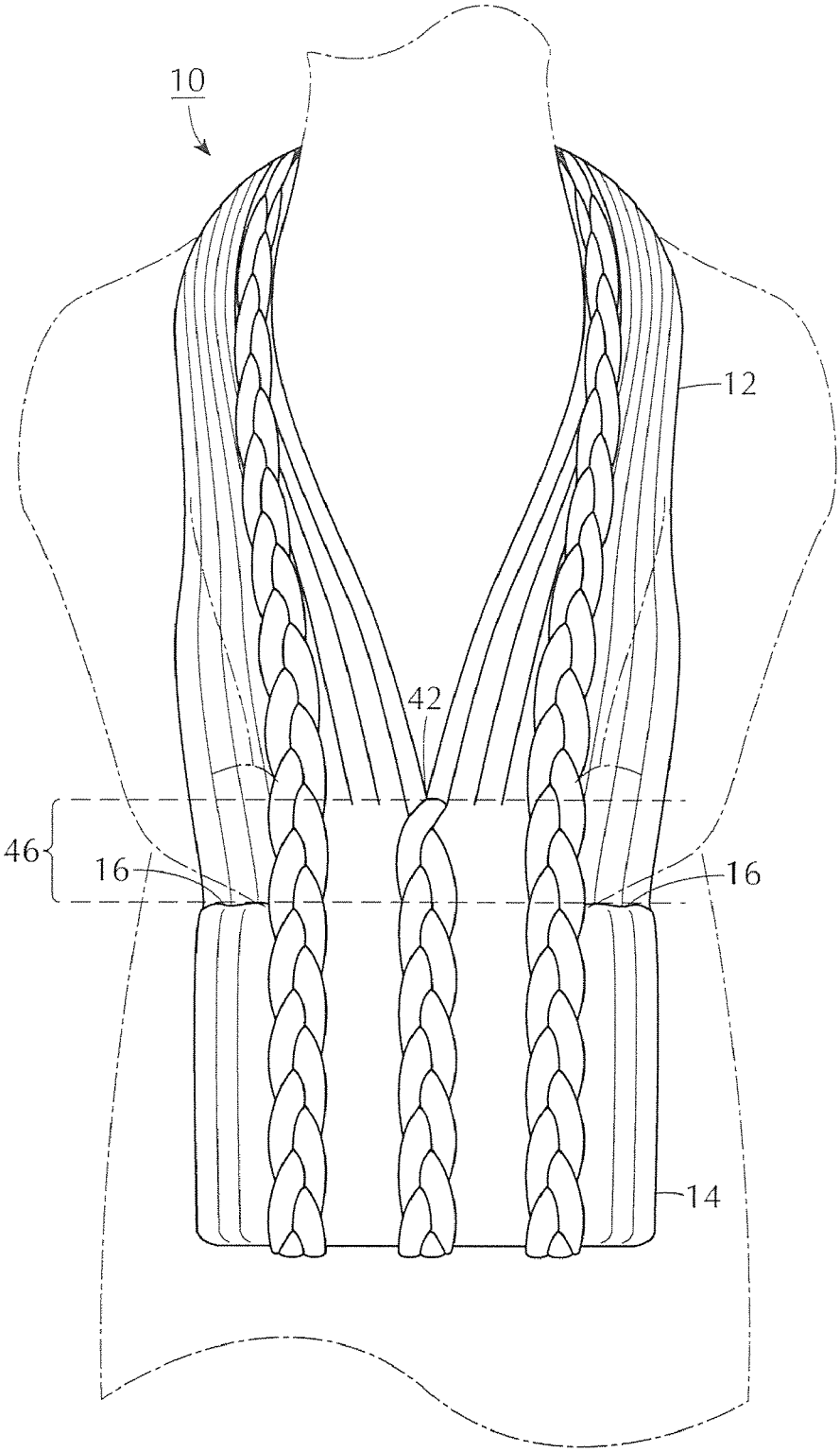
FIG. 3 is an elevation view of the invention presenting the hands of the wearer inserted into the storage receptacle of the muff.
Figure 5:
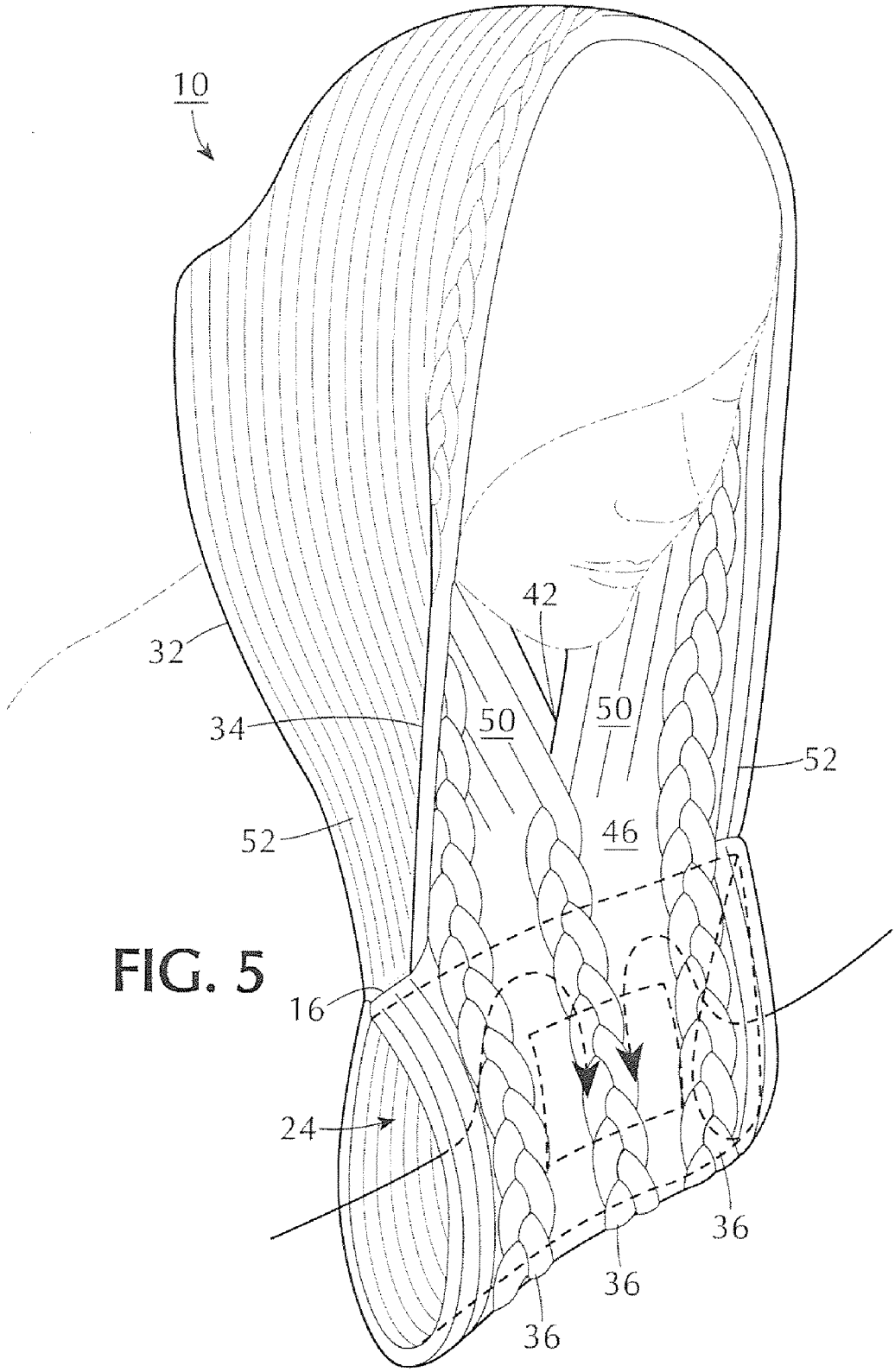
FIG. 5 is a perspective view of the invention illustrating the hands of a wearer inserted into the muff to access a pocket in the passaaeway.
Figure 8:
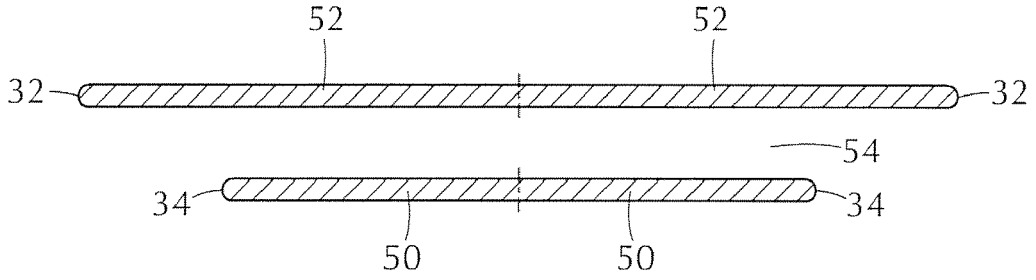
FIG. 8 is a sectional view taken along line 8-8 of FIG. 1 further detailing the cuff construction depicted in the figures.

As depicted in the figures, The cuffs may be joined together a distance above the upper edge of the muff at 42, forming a bib-like portion 46, see FIG. 3, between the point 42 and the upper edge of the muff. The joined width portions 50 form a front layer of the bib, while the joined width portions 52 form a rear layer of the bib, as can perhaps be best seen in FIGS. 5 and 8. The front and rear layers are not interconnected along the height of the bib, thus creating an internal space 54, see FIGS. 6 and 8, between the open sides of the bib, into which the user's hand can be inserted. The space 54 also serves as an enhanced entranceway into the muff receptacle 38, with joined width portions 50 leading to the upper edge of forward cylinder wall portion 28*a*, and joined width portions 52 leading to the upper edge of rear cylinder wall portion 28*b*.

In addition to receptacle 38, the muff may include a small accessory pocket 30 on the surface of inner cylinder 26 inside of horizontal passageway 24, which may be in the form of a knitted rectangle of fabric tacked or otherwise joined on three edges to the inner fabric cylinder to define the pocket. See, e.g., FIG. 6.

The entire garment may preferably be constructed of knit yarn, using knitting and assembly methods known in the art. As such, the shawl portion and at least one of the muff fabric loops can be a continuous fabrication, provided a finished and stylish appearance. As referenced above, cabling 36 may be incorporated into the knit and extend along both the shawl portion and the muff to provide an integrated appearance, as well as to define the front side edge 34 and thus outline the cuff entryways. A further cabling element may extend downward from the point 42 crossing the front of bib 46 and the front of the muff to further integrate those portions of the agerment. Use of a knit yarn, in conjunction with the double wall construction of the muff can also provide a high level of insulation and thus warmth for the hands when inserted into the horizontal passageway 24.

I claim:

1. A garment to be worn by a wearer having a neck and a pair of hands, comprising: a shawl portion to be worn around the neck, shoulder or head portion of the wearer defined by first and second ends and a shawl width extending between first and second edges extending between the ends, and a muff formed at the first and second ends having a transversely-extending passageway with vertically-extending opposed entranceways and configured to receive the pair of hands of the wearer and a receptacle pocket exterior to the transversely-extending passageway with a generally horizontally-extending entranceway along an upper edge of the muff; the said receptacle pocket enveloping the transverse-extending passageway in a concentric configuration; wherein two end regions are respectively located at the first and second ends of the shawl width at which the muff is formed; wherein each of said two end regions is folded upon itself such that a first portion of the shawl width of each region overlies a second portion of the shawl width to form a pair of cuffs, each said cuff leading to the horizontally-extending entranceway of the receptacle pocket.

2. The garment of claim 1, wherein the first portion of the shawl width is of a smaller horizontal extent than the second portion of the shawl width.

3. The garment of claim 1, wherein each said cuff has an interior chamber coupled to the horizontally-extending entranceway of the receptacle pocket.

4. The garment of claim 3, wherein the shawl portion is of a knit construction.

5. The garment of claim 3, wherein each said cuff are joined together above the muff to form a bib extending from a joining point to a lower edge of the two end regions joined to the upper edge of the muff.

6. The garment of claim 5, further comprising a pocket located within the transversely-extending passageway.

7. The garment of claim 5, wherein the bib has separated front and rear faces with an open interior therebetween sized to accommodate the said pair of hands of the wearer positioned between the said two end regions.

8. The garment of claim 7, wherein the open interior of the bib is coupled to an open-sided chamber of each said cuff and to the horizontally-extending entranceway of the receptacle pocket.

9. The garment of claim 1, wherein each said cuff are joined together above the muff to form a bib extending from a joining point to a lower edge of the two end regions joined to the upper edge of the muff.

10. The garment of claim 1, wherein the muff is of a construction having inner and outer generally concentric walls, the receptacle pocket being in the form of a chamber between the inner and outer walls, the transversely-extending passageway being formed by the inner wall.

11. The garment of claim 1, wherein a portion of the receptacle pocket is positioned in front of the transversely-extending passageway.

12. The garment of claim 1, wherein the shawl portion is of a knit construction.

* * * * *